US010753148B2

(12) United States Patent
Jay

(10) Patent No.: US 10,753,148 B2
(45) Date of Patent: Aug. 25, 2020

(54) LIMITER ASSEMBLY FOR A BLIND

(71) Applicant: Rollease Acmeda Pty Ltd, Broadmeadows Victoria (AU)

(72) Inventor: Dean John Jay, Gladstone Park (AU)

(73) Assignee: Rollease Acmeda Pty Ltd, Broadmeadows VIC (AU)

( * ) Notice: Subject to any disclaimer, the term of this patent is extended or adjusted under 35 U.S.C. 154(b) by 193 days.

(21) Appl. No.: 15/552,026

(22) PCT Filed: Feb. 17, 2016

(86) PCT No.: PCT/AU2016/000046
§ 371 (c)(1),
(2) Date: Aug. 18, 2017

(87) PCT Pub. No.: WO2016/131081
PCT Pub. Date: Aug. 25, 2016

(65) Prior Publication Data

US 2018/0155984 A1 Jun. 7, 2018

(30) Foreign Application Priority Data

Feb. 19, 2015 (AU) ..... 2015900567

(51) Int. Cl.
*E06B 9/88* (2006.01)
*E06B 9/68* (2006.01)

(52) U.S. Cl.
CPC ..... *E06B 9/88* (2013.01); *E06B 2009/6881* (2013.01)

(58) Field of Classification Search
CPC ..... E06B 2009/6881; E06B 2009/801; E06B 2009/689; E06B 9/88; E06B 9/80
See application file for complete search history.

(56) References Cited

U.S. PATENT DOCUMENTS 1,725,285 A * 8/1929 Lalonde ..... E06B 9/88 160/295
1,786,512 A * 12/1930 Whitworth ..... E06B 9/88 160/295
1,885,400 A * 11/1932 Ygger ..... E06B 9/88 160/295
2,020,595 A * 11/1935 Weber ..... E06B 9/88 160/295

(Continued)

FOREIGN PATENT DOCUMENTS

DE 19652975 C2 * 11/2003 ..... E06B 9/322
EP 0976910 2/2000

(Continued)

*Primary Examiner* — Johnnie A. Shablack
(74) *Attorney, Agent, or Firm* — Head, Johnson, Kachigian & Wilkinson, PC

(57) ABSTRACT

A limiter assembly to limit extension or retraction of a blind, the limiter assembly comprising an actuator having a limit position and a free position; a first limit member selectively engageable with a blind cylinder, for movement in response to rotation of a blind cylinder during extension or retraction of the blind, the first limit member moving with respect to a stop position only when the actuator is set to the limit position; and a stop to resist movement of the first limit member past the stop position when the actuator is set to the limit position, thereby resisting further rotation of the blind cylinder.

20 Claims, 7 Drawing Sheets

(56) References Cited

U.S. PATENT DOCUMENTS 2,276,740 A * 3/1942 Saito ..... H01H 19/186 200/47
3,559,024 A * 1/1971 Marder ..... E05F 15/665 318/467
3,965,960 A * 6/1976 Massey ..... A47K 3/38 160/295
4,429,729 A * 2/1984 Winslow ..... E06B 9/60 144/193.1
4,482,137 A * 11/1984 Gavagan ..... B60R 5/047 160/315
4,523,620 A * 6/1985 Mortellite ..... E06B 9/60 160/315
5,044,417 A * 9/1991 Bresson ..... E06B 9/72 160/1
5,078,198 A * 1/1992 Tedeschi ..... E06B 9/60 160/301
5,355,741 A * 10/1994 Hsieh ..... A62C 2/24 160/293.1
6,435,252 B2 * 8/2002 Colson ..... E06B 9/32 160/121.1
6,470,951 B1 * 10/2002 Tao ..... E06B 9/322 160/176.1 R
6,628,029 B2 * 9/2003 Astegno ..... E06B 9/72 160/310
7,520,311 B2 * 4/2009 Drew ..... E06B 9/322 160/171
7,857,033 B2 * 12/2010 Malausa ..... E06B 9/88 160/295
8,286,685 B2 * 10/2012 Hsieh ..... E06B 9/78 160/193
8,575,872 B2 * 11/2013 Mullet ..... H02P 3/08 318/255
8,662,139 B2 * 3/2014 Anthony ..... E06B 9/34 160/121.1
8,950,461 B2 * 2/2015 Adams ..... E06B 9/32 160/84.02
9,322,214 B2 * 4/2016 Bohlen ..... E06B 9/88
9,353,570 B2 * 5/2016 Smith ..... E06B 9/38
9,453,370 B2 * 9/2016 Bohlen ..... E06B 9/68
9,617,787 B2 * 4/2017 Bohlen ..... E06B 9/80
9,631,425 B2 * 4/2017 Campagna ..... E06B 9/60
9,739,089 B2 * 8/2017 Smith ..... E06B 9/60
9,834,986 B2 * 12/2017 Bohlen ..... E06B 9/42
10,138,676 B2 * 11/2018 Bohlen ..... E06B 9/62
2015/0042257 A1 * 2/2015 Malausa ..... E06B 9/88 318/626
2015/0047795 A1 * 2/2015 Bohlen ..... E06B 9/62 160/316
2015/0275575 A1 * 10/2015 Haarer ..... E06B 9/42 160/315
2015/0285000 A1 * 10/2015 Liu ..... E06B 9/80 242/396
2015/0376941 A1 * 12/2015 Fujita ..... E06B 9/26 160/241
2017/0175440 A1 * 6/2017 Bohlen ..... E06B 9/80
2017/0218703 A1 * 8/2017 Wei ..... E06B 9/34
2017/0268293 A1 * 9/2017 de Vries ..... E06B 9/72
2017/0298691 A1 * 10/2017 Yamagishi ..... E06B 9/304
2018/0106107 A1 * 4/2018 Smith ..... E06B 9/42
2018/0128048 A1 * 5/2018 Pinese ..... E06B 9/88
2019/0063151 A1 * 2/2019 Chen ..... E06B 9/80

FOREIGN PATENT DOCUMENTS

EP 1983145 A2 * 10/2008 ..... E06B 9/50
FR 2412483 7/1979
FR 2612245 9/1988
FR 2651916 A1 * 3/1991 ..... E06B 9/70
FR 2796980 A1 * 2/2001 ..... E06B 9/88
GB 1537895 A * 1/1979 ..... E06B 9/88
WO WO-2013098108 A1 * 7/2013 ..... E06B 9/88

* cited by examiner

LIMITER ASSEMBLY FOR A BLIND

FIELD

The present invention relates generally to the field of window coverings, and more specifically to a limiter assembly for a blind system.

BACKGROUND

In this specification where a document, act or item of knowledge is referred to or discussed, this reference is not an admission that the document, act or item of knowledge or any combination thereof was at the priority date, publicly available, known to the public, part of the common general knowledge; or known to be relevant to an attempt to solve any problem with which this specification is concerned.

The functional and decorative use of blinds dates back over two thousand years to times when glass windows were not available for architectural applications. In modern times, the use of blinds has become commonplace, as both external and internal coverings, and in both residential and commercial settings.

A blind system typically includes a sheet of fabric (referred to herein as a blind or screen) which is mounted to the top or side of a window or other opening. The blind can be extended to cover the opening, or retracted to the top or side to reveal the opening when desired.

A blind system may need to be fitted to window openings of different dimensions. For instance, a blind system may be used for both taller and shorter windows. For taller window openings, the blind may need to be extended fully in order to cover the opening. However, for shorter window openings, it may be desirable to limit how far the blind can be extended, so that users do not over-extend the blind past the bottom of the window opening—this could cause the blind to billow or to bunch at the bottom.

Blind systems exist which limit the degree of extension or retraction of the blind. However, when installing these blinds, it can be difficult to set the limit appropriately.

SUMMARY

According to a first aspect of the present invention, there is provided a limiter assembly to limit extension or retraction of a blind, the limiter assembly comprising:

an actuator having a limit position and a free position;

a first limit member selectively engageable with a blind cylinder, for movement in response to rotation of the blind cylinder during extension or retraction of the blind, the first limit member moving with respect to a stop position only when the actuator is set to the limit position; and a stop to resist movement of the first limit member past the stop position when the actuator is set to the limit position, thereby resisting further rotation of the blind cylinder.

The present invention enables an installer to more easily set the limiter assembly to limit either extension or retraction of the blind at a desired limit point. Before installation, the first limit member can be positioned at the stop position, and the actuator placed in its free position. The installer can then move the blind to a desired limit point, and set the actuator to its limit position. This will set the stop position (at which the stop resists rotation of the blind) to correspond with the desired limit point. The stop resists further rotation of the blind cylinder past the desired limit point in the limited direction, although rotation in the other direction is still permitted.

The limit assembly may be used to limit either extension or retraction of the blind. In a preferred embodiment, two limit assemblies (one for limiting extension of the blind, one for limiting retraction of the blind) may be contained within a single housing.

Preferably, the limiter assembly further comprises a second limit member which is rotatable to drive movement of the first limit member with respect to the stop position. Setting the actuator to the limit position may engage the second limit member with the blind cylinder, to transmit rotation of the blind cylinder to the second limit member. In turn, this drives movement of the first limit member. Setting the actuator to the free position disengages the second limit member from the blind cylinder, so as to remain relatively stationary when the blind cylinder is rotated.

The second limit member may comprise an externally threaded shaft, and the first limit member may be internally threaded to engage the externally threaded shaft. For example, the first limit member may comprise an internally threaded nut, received on the shaft. By holding the nut against rotation, rotation of the shaft (in response to rotation of the blind cylinder) will cause the nut to move axially along the shaft.

However, alternate embodiments are encompassed within the scope of the broader invention disclosed in this application. By way of non-limiting example, the second limit member may still rotate with the blind cylinder even in the free state, provided that the first limit member does not move with respect to the stop. One such arrangement may be to provide a nut (first limit member) and shaft (second limit member) that co-rotate when the actuator is in the free position, but when the actuator is in the limit position the nut is held against rotation such that it moves axially along the shaft.

The actuator may be operated in a number of ways, and may be movable back and forth between the free and limit positions. In a preferred embodiment, the actuator comprises a button that can be depressed in order to move between the limit position and the free position. In one example, the button may be spring biased towards the free position (where the button is extended). Depression of the button moves it to the limit position, where a holding mechanism prevents it from returning to the free position. Further depression of the button releases the holding mechanism and allows the button to return to the free position.

The limiter assembly may further comprise a transmission component engaged to rotate with the blind cylinder, and selectively engageable with the second limit member. Setting the actuator to the limit position can move the transmission component along its axis of rotation and into engagement with the second limit member, to transmit rotation of the blind cylinder to the second limit member. When the actuator is set to the free position, a biasing element may bias the transmission component axially away from and out of engagement with the second limit member. The transmission component may be axially aligned with the externally threaded shaft of the second limit member.

The transmission component may be forced into engagement with the second limit member by a cam member. The cam member may act to translate depression of the actuator into transverse movement of the transmission component along its axis of rotation.

In a further aspect of the present invention, there is provided a blind system comprising:

a blind extendible and retractable by rotation of a blind cylinder; and a limiter assembly according to the first aspect of the present invention, to limit at least one of extension or retraction of the blind.

The limiter assembly of the first aspect of the present invention may be used to set either an extension limit for the blind or a retraction limit for the blind.

In a further aspect of the present invention, there is provided a blind system comprising:

a blind extendible and retractable by rotation of a blind cylinder;

a first limiter assembly, according to the first aspect of the present invention, to limit extension of the blind; and a second limiter assembly, according to the first aspect of the present invention, to limit retraction of the blind.

In a further aspect of the present invention, there is provided a method of configuring a limiter assembly according to the first aspect of the present invention, the method comprising:

setting the first limit member to the stop position;

setting the actuator to the free position;

moving the blind to a desired limit point; and setting the actuator to the limit position.

A detailed description of one or more embodiments of the invention is provided below, along with accompanying figures that illustrate by way of example the principles of the invention. While the invention is described in connection with such embodiments, it should be understood that the invention is not limited to any embodiment. On the contrary, the scope of the invention is limited only by the appended claims and the invention encompasses numerous alternatives, modifications and equivalents.

For the purpose of example, numerous specific details are set forth in the following description in order to provide a thorough understanding of the present invention. The present invention may be practiced according to the claims without some or all of these specific details. For the purposes of clarity, technical material that is known in the technical fields related to the invention has not been described in detail so that the present invention is not unnecessarily obscured.

BRIEF DESCRIPTION OF THE DRAWINGS

Various embodiments/aspects of the invention will now be described with reference to the following drawings.

DETAILED DESCRIPTION

Figure 1:
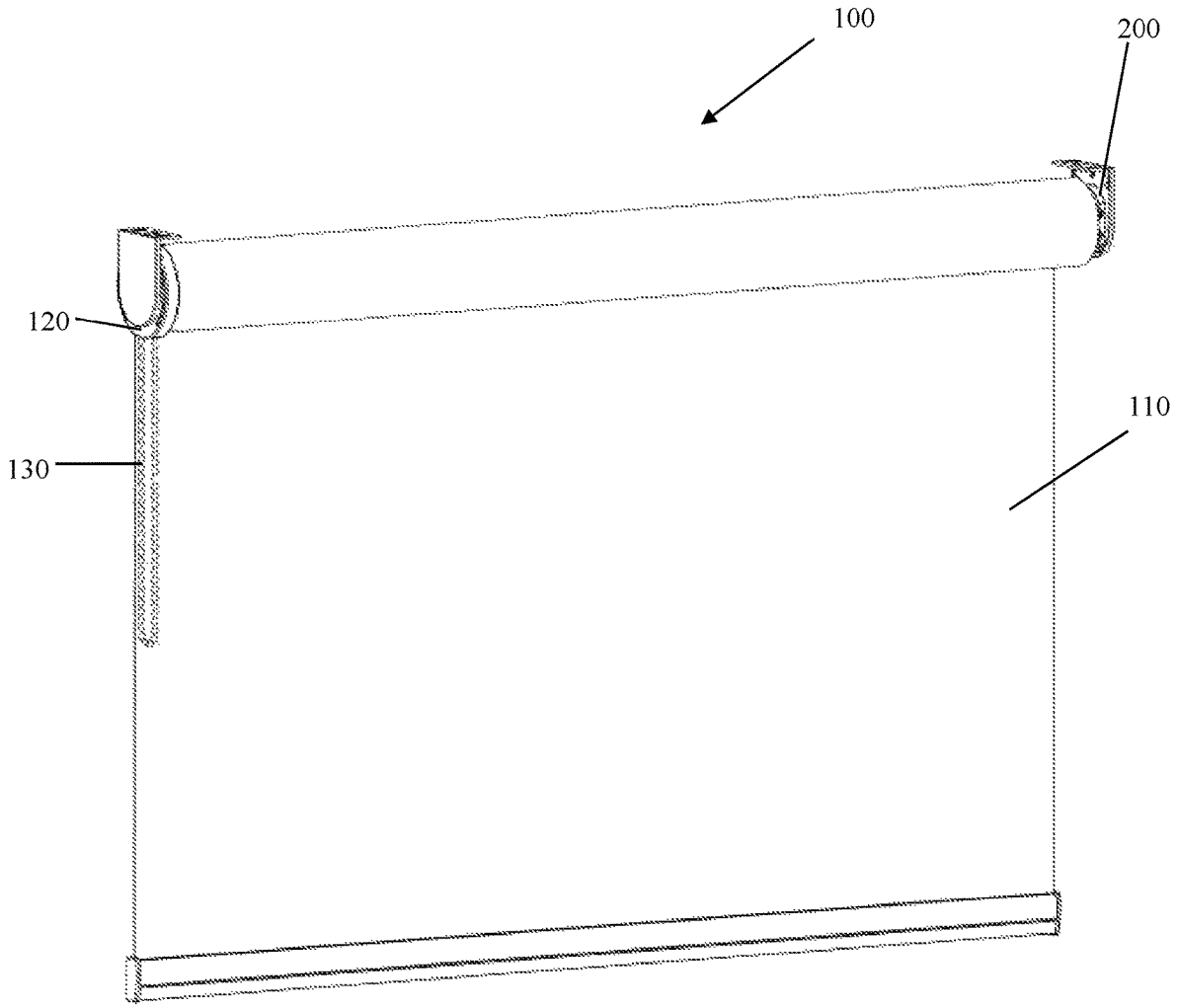
FIG. 1 is a perspective view of a blind system according to an embodiment of the present invention.

FIG. 1 depicts a blind system 100 according to an embodiment of the present invention. The blind system 100 includes a blind 110, a cord winder 120 with cord 130, and a dual limiter assembly 200, which acts to limit both the extension and retraction of the blind 110. The present invention has particular application to systems where the blind 110 is manually operated by a user, using a chain or cord 130, or alternatively by directly drawing on a weight bar secured to an end of the blind.

The dual limiter assembly 200 of this embodiment contains a bottom limiter assembly 300 (to limit extension of the blind) and a top limiter assembly 300A (to limit retraction of the blind) within housing 210. A top limiter assembly 300A can help prevent over-retraction of the blind 110, which could potentially damage the fabric or the winder 130. However, the operation of the present invention will be described primarily with reference to the bottom limiter 300, to limit extension of the blind 110. Equivalent parts of the top limiter 300A, where visible in the figures, are marked with the same reference numeral but with an 'A' suffix.

Figure 2:
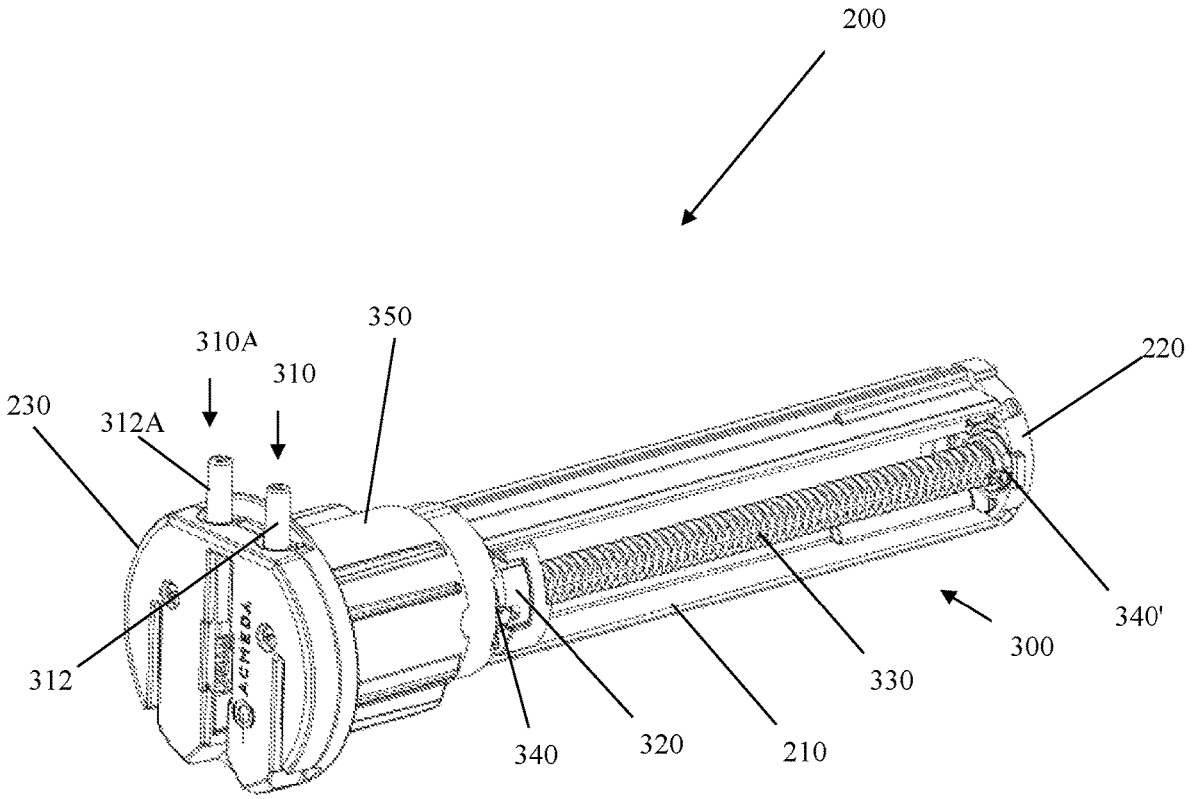
FIG. 2 is a perspective view of a dual limiter assembly according to an embodiment of the present invention, having both actuators in the free position.
Figure 3:
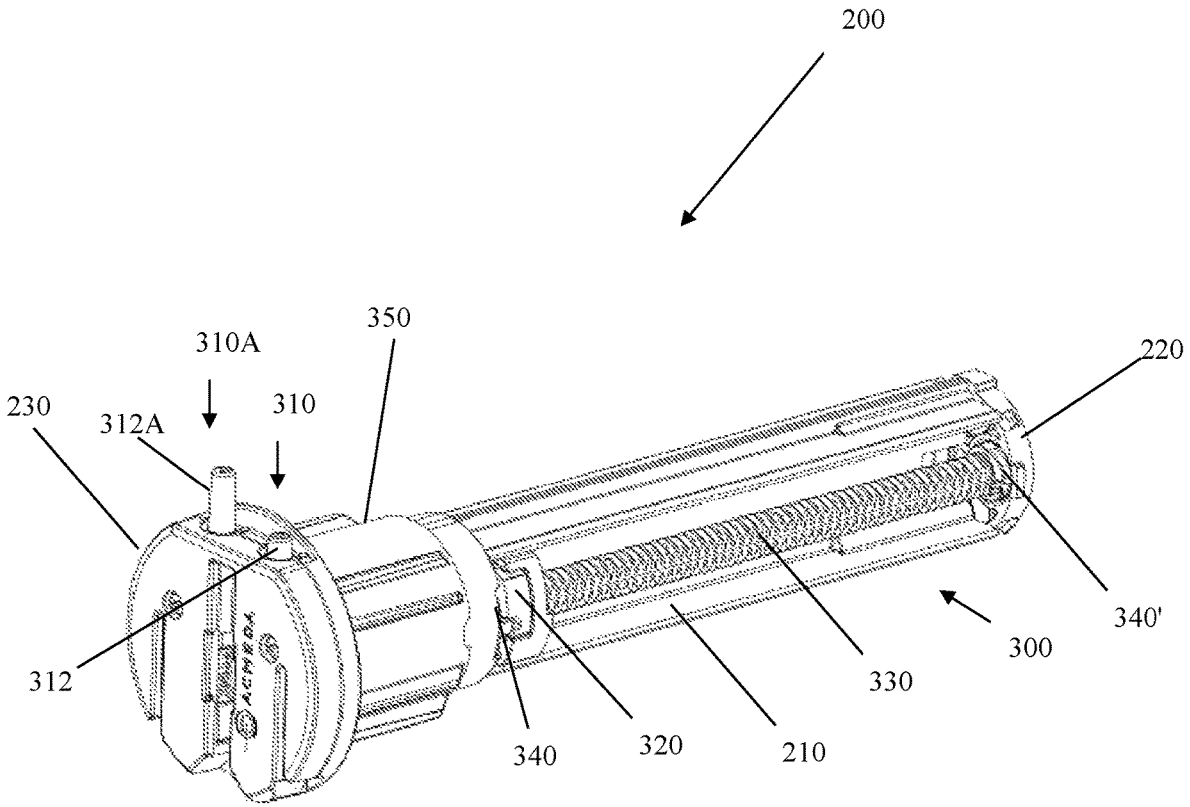
FIG. 3 is a perspective view of a limiter assembly of FIG. 2, with an actuator for one limiter in the limit position.

The bottom limiter 300 comprises an actuator 310, which can be set between a free position (FIG. 2) and a limit position (FIG. 3. When the actuator 310 is set to the limit position, the limiter 300 acts to limit extension of the blind. However, with the actuator 310 in the free position, the limiter 300 does not limit extension of the blind 110.

Referring to FIGS. 2 to 6, the operation of the limiter assembly 300 acts by limiting movement of a nut 320 (first limit member) along a shaft 330 (second limit member). When the actuator 310 is set to the free position, the shaft 330 and nut 320 both remain stationary. However, when the actuator 310 is set to the limit position, the shaft 330 rotates in response to rotation of a blind cylinder (not shown). The nut 320 is held against rotation, so that rotation of the shaft 330 causes the nut 320 to move along the axis of the shaft 330.

Figure 5:
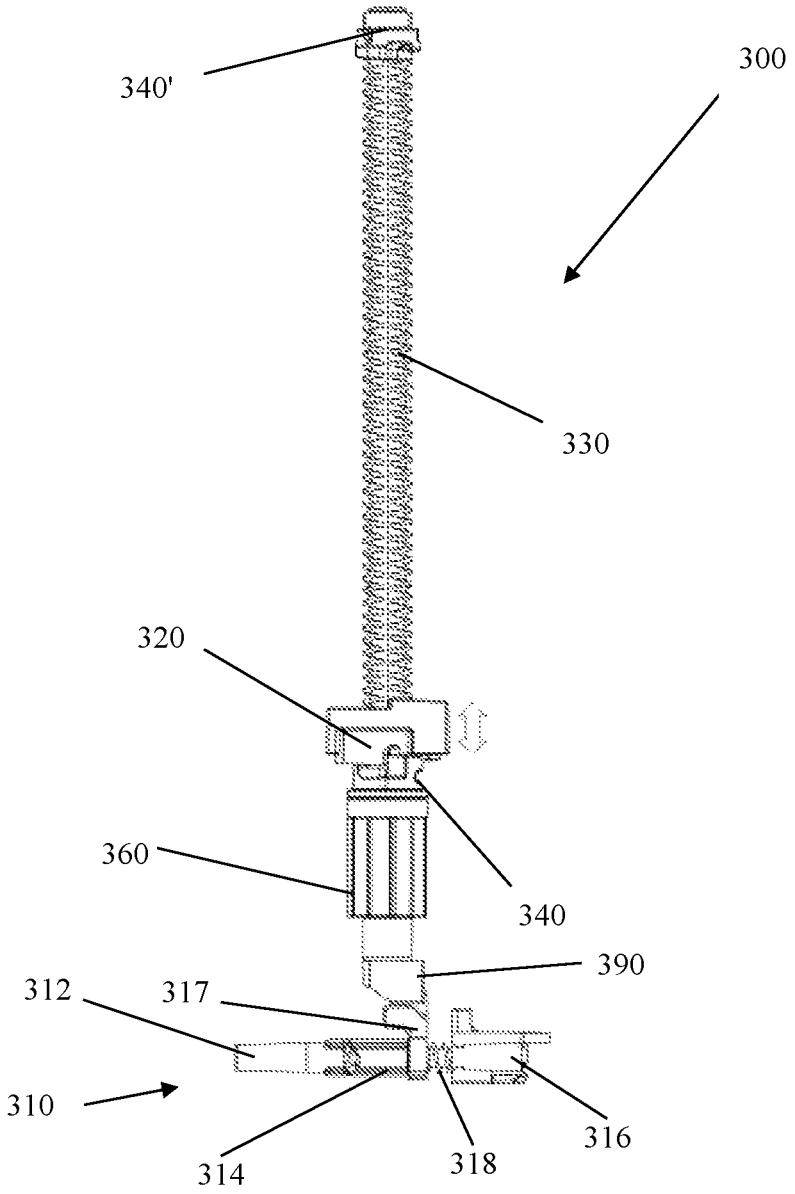
FIG. 5 is a side view showing interacting components of the limiter assembly of FIG. 2, for one of the limits, with the actuator in the limit position.
Figure 6:
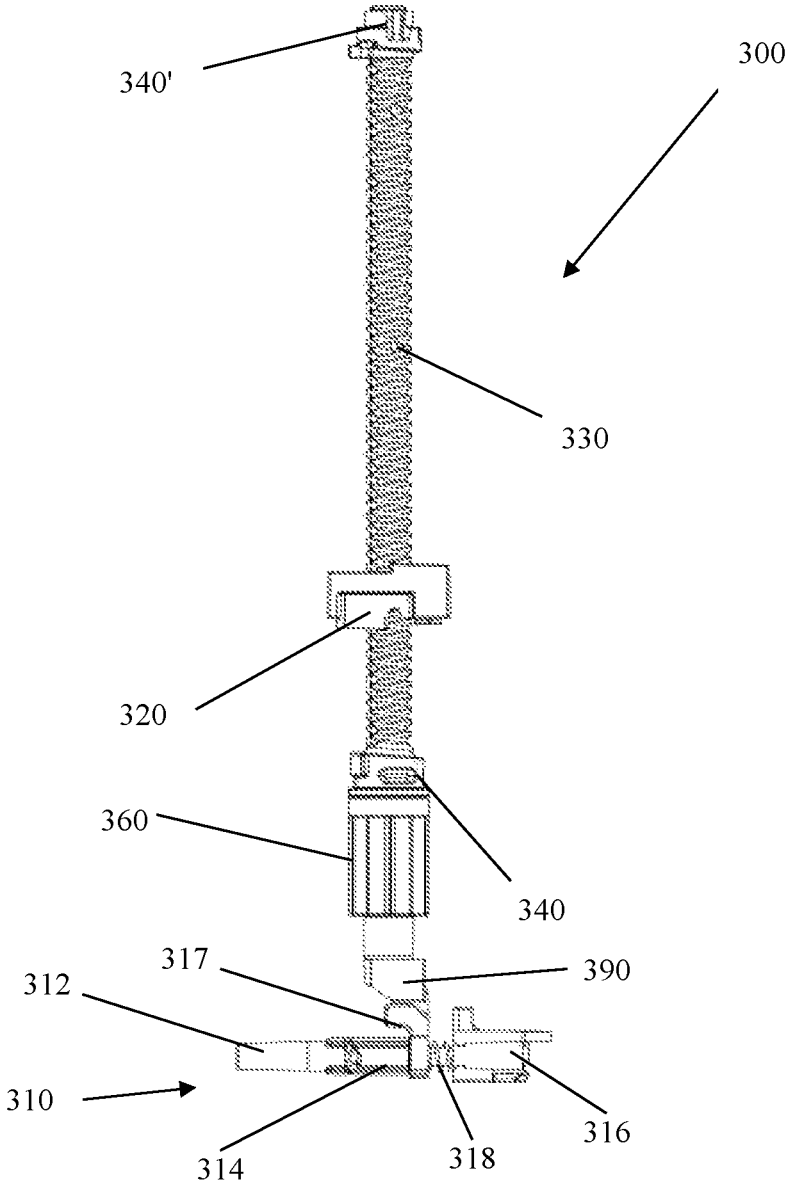
FIG. 6 is the side view of FIG. 5, showing the second limit member moved away from the stop position.

FIGS. 3 and 5 show the actuator 310 in the limit position, and the nut 320 in a stop position, which is substantially at one end of the shaft 330. In this position, the nut abuts a stop 340. From the stop position, if the blind cylinder is rotated to retract the blind 110, the nut 320 is moved along the axis of the shaft 330, away from the stop position as shown in FIG. 6. However, if a user tries to extend the blind 110 past the stop position, the nut 320 is urged against the stop 340, which resists movement of the nut 320, thereby resisting rotation of the blind cylinder (and resisting further extension of the blind 110). The limiter assembly 300 has sufficient structural integrity to enable the stop 340 to physically resist the ordinary forces applied during extension of the blind 110.

Figure 4:
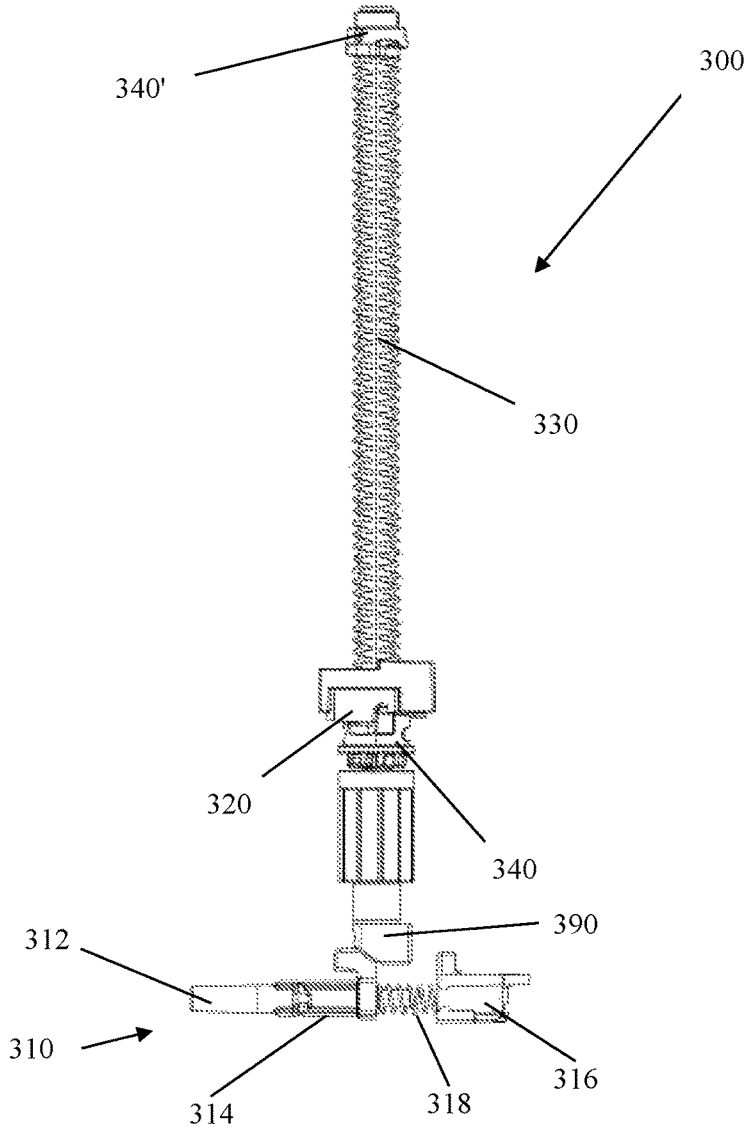
FIG. 4 is a side view showing interacting components of the limiter assembly of FIG. 2, for one of the limits, with the actuator in the free position.

The limiter assembly 300 includes another gear, crown gear 350, that directly engages with the blind cylinder. Rotation of the blind cylinder therefore results in rotation of the crown gear 350. The crown gear 350 has internal splines which engage with transmission component 360, so that the transmission component 360 also rotates in response to rotation of the blind cylinder. Operation of the actuator 310 acts to selectively engage the transmission component 360 with shaft 330, resulting in selective movement of the nut 320 along shaft 330 in response to rotation of the blind cylinder. When the actuator 310 is in its free position, as shown in FIG. 4, the transmission component 360 is biased away from and out of engagement with the end of the shaft 330 (by spring 370, seen in FIG. 7). Therefore, rotation of the blind cylinder is not transmitted to the shaft 330.

However, when the actuator 310 is depressed it moves to its limit position, as shown in FIG. 5, where the transmission component 360 engages the end of shaft 330. The transmission component 360 has internal splines which engage with corresponding formations on the end of shaft 330 such that rotation of the blind cylinder is transmitted through crown gear 330 and transmission component 360 to shaft 330. Rotation of the shaft in turn drives axial movement of the nut 320, as shown by the arrows in FIG. 5. In this embodiment, for the bottom limit assembly 300, nut 320 will move away from the stop position in response to retraction of the blind 110, as shown in FIG. 6. Extension of the blind 110 will move the nut 320 back towards the stop position until rotation of the blind cylinder is stopped by stop 340, thereby limiting extension of the blind 110.

Although another stop 340' is depicted at the other end of shaft 330, the nut 320 of bottom limiter 300 is not expected to travel as far as stop 340' during ordinary use. On the other hand, in the top limiter 300A, the stop 340'A is the functional stop which acts to limit retraction of the blind, whereas the nut is not expected to travel as far as stop 340A during ordinary use.

At a high level, actuator 310 is a spring-loaded button that acts in a manner similar to a ball-point pen—click (depress) to move to the limit position, click to release back to the free position. Actuator 310 includes a button 312, a button driver 314, a base 316 and a projecting member 317. Depressing the button 312 has two effects, as set out in further detail below.

Firstly, a cam face on the bottom of button 312 engages a cam face on the top of button driver 314, causing the button driver 314 to rotate. The button driver 314 alternates, with each press of the button 312, between a locked position where it engages with the housing (e.g. engaging with a flange or in a recess in the housing) and maintains the button 312 in its limit position, and a release position where it allows the spring 318 (acting on the bottom of projecting member 317) to force the button 312 back to its free position. The rotation of the button driver 314 therefore allows a user to easily select either the limit position or the free position of the actuator 310.

Secondly, the depression of button 312 results in projecting member 317 also being forced downward towards base component 316. The projecting member 317 has a cam face on its underside, which engages cam member 390. Cam member 390 slides perpendicular to the button movement, and forces the transmission component 360 axially into engagement with the end of the shaft 330, as shown in FIG. 5.

Figure 7:
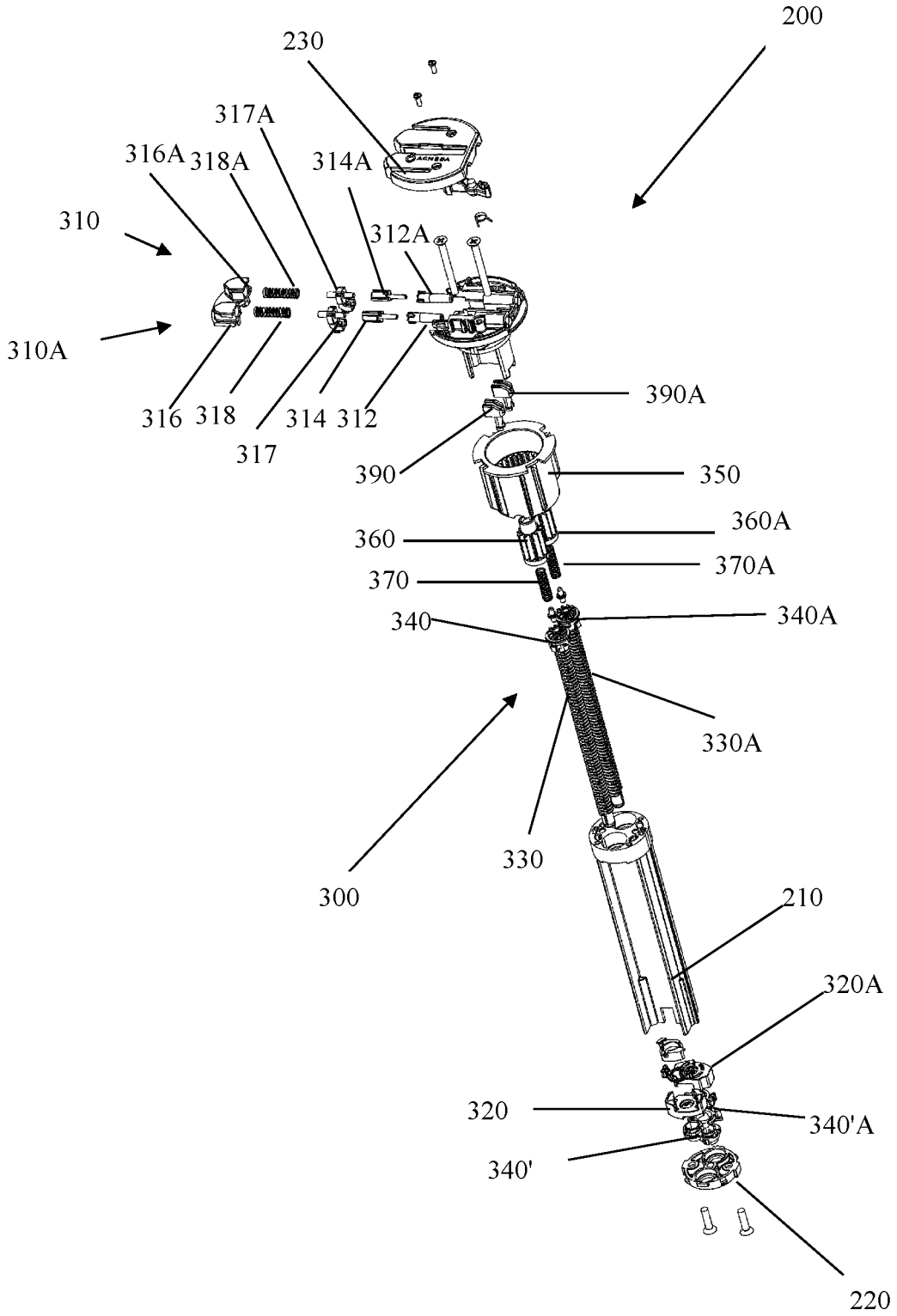
FIG. 7 is an exploded view of the dual limiter assembly of FIG. 2.

FIG. 7 depicts an exploded view of the dual limiter assembly 200. As shown in FIG. 7, the dual limiter assembly 200 comprises a housing 210, with internal end cover 220 and external end cover 230, to house the components of both the bottom limiter assembly 300 and top limiter assembly 300A.

Installation of the blind system 100, with the dual limiter assembly 200, can be performed as follows. The nuts 320, 320A are set to their respective stop positions (usually prior to assembly of the system), and the bottom and top actuators 310, 310A are set to their free position. In this embodiment, it should be noted that the bottom limiter assembly 300 and top limiter assembly 300A are identical, except for the initial positioning of the nuts 320, 320A—nut 320 is initially set adjacent stop 340, and nut 320A is initially set adjacent stop 340'A at the other end of the corresponding shaft 330A. The blind 110 is moved in turn to its desired limit position (e.g. by operating cord 130 or by directly handling blind). Either the top or bottom limit can be set first. When the blind 110 is at its desired top limit position, the top actuator 310A is pressed, to set the top limiter assembly 300 to its limited state (i.e. with the top actuator in the limit position). Further retraction of the blind 110 is then prevented by engagement of nut 320A with stop 340'A, while extension of the blind results in nut 320A moving away from stop 340'A. When the blind is at its desired bottom limit position, the bottom actuator 310 is pressed to set the bottom limiter assembly 300 to its limited state (i.e. with the bottom actuator in the limit position). Further extension of the blind 110 is then prevented by engagement of nut 320 with stop 340, while retraction of the blind results in nut 320 moving away from stop 340. Extension or retraction of the blind 110 is then limited to between these desired top and bottom limit positions.

Although an embodiment of the present invention has been described, numerous modifications are possible within the scope of the invention. For example, although the present invention has been described with reference to a blind that is extended and retracted vertically, and with particular reference to setting the bottom limit of such a blind, the invention may also be applied to blinds that are extended and retracted horizontally.

Furthermore, the movement of the first limit member with respect to the stop may be achieved in a variety of ways. For example, the first limit member may be the rack in a rack and pinion arrangement, and the stop may act to resist translation of the rack past a stop position. Furthermore, although the first limit member (nut 320) described above moves along an axis with respect to the stop, in other embodiments the first limit member could have a rotational stop position (e.g. the first limit member could purely rotate around less than 360 degrees, without moving along an axis; the first limit member might then have a flange to engage the stop to prevent further rotation past the stop position).

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

The invention claimed is:

1. A limiter assembly to limit extension or retraction of a manually operated blind, the limiter assembly comprising:

an actuator having a limit position and a free position;

a first limit member within a blind cylinder and selectively engageable with the blind cylinder, for movement in response to rotation of a blind cylinder during manually operated extension or retraction of the blind, a stop to resist movement of the first limit member past a stop position when the actuator is set to the limit position and to resist rotation of the blind cylinder, wherein the stop does not resist movement of the first limit member past the stop position when the actuator is set to the free position.

2. The limiter assembly according to claim 1, further comprising:

a second limit member which is rotatable to drive movement of the first limit member with respect to the stop position, wherein setting the actuator to the limit position engages the second limit member with the blind cylinder to transmit rotation of the blind cylinder to the second limit member, and setting the actuator to the free position disengages the second limit member from the blind cylinder.

3. The limiter assembly according to claim 2, wherein the second limit member comprises an externally threaded shaft and wherein the first limit member is internally threaded to engage the externally threaded shaft, and is held against rotation at least when the actuator is set to the limit position.

4. The limiter assembly according to claim 3, further comprising:

a transmission component engaged to rotate with the blind cylinder, wherein setting the actuator to the limit position moves the transmission component along its axis of rotation and into engagement with the second limit member to transmit rotation of the blind cylinder to the second limit member.

5. The limiter assembly according to claim 4, further comprising a biasing element to bias the transmission component axially away from the second limit member, when the actuator is set to the free position.

6. The limiter assembly according to claim 5, wherein the transmission component and the externally threaded shaft are axially aligned along a common axis of rotation.

7. The limiter assembly according to claim 4, further comprising:

a crown gear directly engaged with the blind cylinder and engaged with the transmission component, to transmit rotation of the blind cylinder to the transmission component.

8. The limiter assembly according to claim 7, wherein the crown gear is directly engaged with the transmission component.

9. The limiter assembly according to claim 4, wherein the actuator is set to the limit position by depressing the actuator in a direction transverse to the axis of rotation of the transmission component, the limiter assembly further comprising:

a cam member to translate depression of the actuator into movement of the transmission component along its axis of rotation into engagement with the second limit member.

10. The limiter assembly according to claim 1, wherein the actuator is set to the limit position by depressing the actuator.

11. The limiter assembly according to claim 10, further comprising:

an actuator biasing element to bias the actuator to the free position; and a holding mechanism to selectively hold the actuator in the limit position.

12. A manually operated blind system comprising:

a manually operated blind extendible and retractable by rotation of a blind cylinder; and a limiter assembly according to claim 1, to limit extension or retraction of the blind.

13. The manually operated blind system of claim 12, wherein the limiter assembly limits extension of the blind.

14. The manually operated blind system of claim 12, wherein the limiter assembly limits retraction of the blind.

15. The manually operated blind system according to claim 12, further comprising a cord operable by a user to extend or retract the blind.

16. The manually operated blind system according to claim 12, further comprising a weight bar secured to an end of the blind, operable by a user to extend or retract the blind.

17. The limiter assembly according to claim 1, wherein the actuator is set to the free position by depressing the actuator.

18. A manually operated blind system comprising:

a manually operated blind extendible and retractable by rotation of a blind cylinder;

a first limiter assembly, according to claim 1, to limit extension of the blind; and a second limiter assembly, according to claim 1, to limit retraction of the blind.

19. A method of configuring a limiter assembly for a manually operated blind system according to claim 1, the method comprising:

setting the first limit member to the stop position;

setting the actuator to the free position;

moving the blind to a desired limit point; and setting the actuator to the limit position.

20. A dual limiter assembly to limit extension and retraction of a manually operated blind, comprising:

a first limiter assembly, according to claim 1, to limit extension of the blind;

a second limiter assembly, according to claim 1, to limit retraction of the blind; and a housing containing both the first limiter assembly and second limiter assembly.

* * * * *